US009962575B2

(12) United States Patent
Askins

(10) Patent No.: US 9,962,575 B2
(45) Date of Patent: May 8, 2018

(54) APPARATUSES AND METHODS TO INCREASE NECK STRENGTH AND LIMIT CONCUSSION RISK

(71) Applicant: Craig Askins, Brighton, MI (US)

(72) Inventor: Craig Askins, Brighton, MI (US)

( * ) Notice: Subject to any disclaimer, the term of this patent is extended or adjusted under 35 U.S.C. 154(b) by 0 days. days.

(21) Appl. No.: 14/996,175

(22) Filed: Jan. 14, 2016

(65) Prior Publication Data

US 2017/0203148 A1 Jul. 20, 2017

(51) Int. Cl.

| | |
|---|---|
| ***A63B 23/025*** | (2006.01) |
| ***A63B 21/00*** | (2006.01) |
| ***A63B 21/04*** | (2006.01) |
| ***A63B 21/02*** | (2006.01) |
| ***A63B 21/055*** | (2006.01) |

(52) U.S. Cl.

CPC ..... *A63B 23/025* (2013.01); *A63B 21/00185* (2013.01); *A63B 21/026* (2013.01); *A63B 21/0407* (2013.01); *A63B 21/055* (2013.01); *A63B 21/4003* (2015.10); *A63B 21/4029* (2015.10); *A63B 21/4035* (2015.10)

(58) Field of Classification Search

CPC ..... A63B 21/00185; A63B 21/4003; A63B 21/4025; A63B 21/28; A63B 21/285; A63B 21/4019; A63B 21/4021; A63B 21/4033; A63B 21/4035; A63B 21/16–21/169; A63B 21/026; A63B 21/04; A63B 21/0407; A63B 21/0442; A63B 21/055; A63B 21/0552; A63B 21/0555; A63B 21/0557; A63B 23/025; A63B 2023/006; A63B 23/03; A61H 2201/1604; A61H 2205/02; A61H 2205/04

USPC ..... 482/10, 11, 121–126, 129

See application file for complete search history.

(56) References Cited

U.S. PATENT DOCUMENTS

| | | | | |
|---|---|---|---|---|
| 1,517,147 A | | 11/1924 | Burnett | |
| 1,543,346 A | | 6/1925 | Titus | |
| 4,019,734 A | * | 4/1977 | Lee | A63B 21/0552 482/125 |
| 4,168,060 A | | 9/1979 | Hohenfeldt | |
| 4,219,193 A | | 8/1980 | Newman | |
| 4,278,249 A | | 7/1981 | Forrest | |
| 4,339,124 A | | 7/1982 | Vogler | |

(Continued)

OTHER PUBLICATIONS

CerviFIT® Neck Strengthening System—Just Train It—Anatomical Architects, Inc., www.cervifit.com.

(Continued)

*Primary Examiner* — Gregory Winter

(74) *Attorney, Agent, or Firm* — Milbank, Tweed, Hadley & McCloy, LLP

(57) ABSTRACT

An apparatus used to strengthen muscles of the neck, which includes a head strap that wraps snugly and comfortably around the head of a user, a hook and loop fastener component that connects the head strap with an elastic tube at each end of the tube; and a handle that is attached along the elastic tube. The user wears the apparatus around the head, and extends the handle taut to create tension in the neck. When the elastic tube is extended, the user performs full range of motion exercises to strengthen the neck. A user of this apparatus has increased neck strength which correlates with a lower risk for sustaining a concussion.

8 Claims, 4 Drawing Sheets

(56) References Cited

U.S. PATENT DOCUMENTS

| | | | | | |
|---|---|---|---|---|---|
| 4,441,707 | A * | 4/1984 | Bosch | A63B 21/151 | 482/131 |
| 4,456,249 | A * | 6/1984 | Calabrese | A63B 21/154 | 482/124 |
| 4,468,023 | A | 8/1984 | Solloway | | |
| 4,645,198 | A | 2/1987 | Levenston | | |
| 4,685,671 | A * | 8/1987 | Hagerman | A63B 21/04 | 482/124 |
| 4,789,154 | A | 12/1988 | Mattox | | |
| 4,832,333 | A | 5/1989 | Lockett | | |
| 4,893,808 | A | 1/1990 | McIntyre et al. | | |
| 4,948,117 | A * | 8/1990 | Burke | A63B 69/12 | 482/129 |
| 4,988,093 | A | 1/1991 | Forrest, Sr. et al. | | |
| 5,052,365 | A * | 10/1991 | Carella | F41B 5/1476 | 124/88 |
| 5,116,359 | A | 5/1992 | Moore | | |
| 5,324,247 | A | 6/1994 | Lepley | | |
| 5,336,139 | A | 8/1994 | Miller | | |
| 5,498,218 | A | 3/1996 | Proctor et al. | | |
| 5,505,677 | A * | 4/1996 | Hinds | A63B 21/0004 | 482/10 |
| 5,507,707 | A | 4/1996 | Miller | | |
| 5,509,869 | A | 4/1996 | Miller | | |
| 5,514,059 | A * | 5/1996 | Romney | A63B 21/0004 | 482/121 |
| 5,662,554 | A | 9/1997 | Schaefer | | |
| 5,803,881 | A * | 9/1998 | Miller | A63B 21/0004 | 482/124 |
| 6,000,066 | A | 12/1999 | Williams | | |
| 6,036,625 | A | 3/2000 | Woodruff | | |
| 6,093,137 | A | 7/2000 | Summers | | |
| 6,099,445 | A | 8/2000 | Rovinsky et al. | | |
| 6,152,857 | A | 11/2000 | Gonzalez-Leal | | |
| 6,179,747 | B1 | 1/2001 | Kelley | | |
| 6,190,288 | B1 | 2/2001 | Fisher | | |
| 6,217,482 | B1 | 4/2001 | Yoo et al. | | |
| 6,984,184 | B2 * | 1/2006 | Gray | A63B 21/0004 | 473/458 |
| D593,167 | S * | 5/2009 | Vigilia | D21/662 | |
| 7,549,948 | B2 | 6/2009 | Makofsky | | |
| 7,662,066 | B2 | 2/2010 | Ferrara | | |
| 8,308,616 | B1 | 11/2012 | Flavell | | |
| 8,613,690 | B1 | 12/2013 | Thompson | | |
| 8,840,528 | B2 | 9/2014 | Zylstra | | |
| 8,876,665 | B1 | 11/2014 | Isom | | |
| 9,149,676 | B2 * | 10/2015 | Callanan | A63B 21/02 | |
| 9,198,820 | B2 | 12/2015 | Philipson | | |
| 9,526,965 | B2 * | 12/2016 | Gatherer | A63B 71/0054 | |
| 2010/0125011 | A1 * | 5/2010 | Capps | A63B 69/0059 | 473/451 |
| 2012/0245002 | A1 * | 9/2012 | Todd | A63B 21/4025 | 482/124 |
| 2013/0085041 | A1 * | 4/2013 | Jolly | A63B 23/025 | 482/10 |
| 2014/0200499 | A1 * | 7/2014 | Champion | A63B 21/151 | 602/36 |

OTHER PUBLICATIONS

Our Gear—Quality is Paramount in Every Aspect of our Design and Construction—The Neck Flex Head Harness; http://www.theneckflex.com/projects/.

Physiotherapist's invention intended to reduce athletes' concussion risk; By Hank Daniszewski, The London Free Press, Monday, Feb. 22, 2016; http://www.lfpress.com/2016/02/22/physiotherapists-invention-intended-to-reduce-athletes-concussion-risk.

The Most Efficient Neck Strengthening Workout is a Revolution, 360°; The Iron Neck—The Iron Neck Home; http://www.iron-neck.com/.

A Wearable Collar is Hoping to Provide a Major Breakthrough in Concussion Prevention Tech; http://www.sporttechie.com/2016/06/01/gadgets/gear/a-wearable-collar-is-hoping-to-provide-major-breakthrough-in-concussion-prevention-tech/.

Product Archive—Sport Shildz; Home; https://www.sportshildz.com/shop/.

Philantropists Andy and Helen Spriet have stepped in to help a sports medicine clinic cope with surging demand, by Dan Brown, Hank Daniszewski, The London Free Press, Wednesday, Apr. 6, 2016; http://www.lfpress.com/2016/04/05/philanthropists-andy-and-helen-spriet-have-stepped-in-to-help-a-sports-medicine-clinic-cope-with-surging-demand.

Nexerciser Isotonic and Isometric SA—Neck Muscle Tester; https://www.healthproductsforyou.com/p-nexerciser-sotonic-and-isometric-neck-muscle-tester.html.

Heat Strat Kit M351KT—Medicordz®; https://nzcordz.com/product/head-strap-kit-medicordz/.

J. Eckner, et al., Effect of Neck Muscle Strength and Anticipatory Cervical Muscle Activation on the Kinematic Response of the Head to Impulsive Loads, pp. 566-576, The American Journal of Sports Medicine; http://ajs.sagepub.com/.

* cited by examiner

APPARATUSES AND METHODS TO INCREASE NECK STRENGTH AND LIMIT CONCUSSION RISK

FIELD OF THE INVENTION

This disclosure relates to training apparatuses used as a means for training athletes of all ages and genders. More particularly, the invention relates to apparatuses and methods for strength training, conditioning, and rehabilitating muscles in the head, neck, shoulders and upper back, all of which stabilize the head.

BACKGROUND

There is a long felt need for apparatuses that require a full range of motion of neck muscles. A full range of motion of these muscles results in increased muscle mass in the neck. Currently, many exercises that target neck muscles are isometric which by nature only target and strengthen subsets of these muscles. Increased range of motion during neck exercises target a broader range of neck muscles, and result in overall neck strength.

Concussions are disruptions of normal brain activity resulting from an impact. Concussions could result from a hit to the head or a violent shock as from a hit not only from blows to the head, but also 1) from body blows that result in whiplash, and 2) whiplash that occurs when the body contacts the ground.

While there has been a focus on concussions in obvious collision sports such as football, recent studies suggest that people of any age and gender who participate in contact sports are not immune to the risks of concussions. In fact, one study suggests that the majority of all concussions are suffered by females. Similarly, because of their lack of neck muscle, children are also vulnerable to the risks of concussions.

In contact sports, a person could suffer a concussion when his or her neck is jolted or suddenly whiplashed. Not surprisingly, a faster or more accelerated movement of the head results in more serious head injuries. However, a person with increased muscle mass in the neck will have more stability during such a collision, and this person's head and neck will jolt or rotate at a decelerated speed upon impact compared to a person with less muscle mass or strength. Therefore, it has been suggested that a person with increased muscle mass in the neck will have lower risk of suffering a concussion. As such, athletic trainers strength & conditioning coaches have begun to include neck strength exercises on a collegiate level in order to increase neck strength in an effort to reduce the concussion rate.

Previously, exercise equipment was isometric by nature and failed to allow the user to exercise a full range of motion, including rotational movement in the head. Further, many of the previous inventions that attempted to address a broader range of motion were bulky, heavy, loose-fitting, uncomfortable, or require multiple users. Here, the embodiments of the present disclosures teach exercises that are both isotonic and isometric (i.e., having or lacking movement) by nature. Isotonic exercises provide movement of the muscle when force is applied. Isometric do not provide movement of the when force is applied. In other words, when a muscle is in motion, isotonic force is applied; when a muscle is in a stationary position, isometric force is applied. Indeed, embodiments of the invention cause concentric contractions (i.e., shortening) of a muscle and eccentric contractions (i.e., lengthening) of the same or a different muscle.

The resistance level provided by disclosure is appropriate to the level of strength of athletes. It provides a number of ways for the athlete to progress as additional strength gains are achieved including the built-in progression.

Professional and collegiate teams have known the benefits of neck strengthening and have incorporated it into their training for decades. As the understanding of the risks of concussion and the higher likelihood of occurrence in young athletes (especially young females) continues to increase, it only makes sense to provide them with an easy-to-use, inexpensive way to prepare their necks for the rigors of participation in sports.

The application of a proper head and neck resistance training program will result in increased passive stiffness of the head and neck. Regular resistance training has exhibited increases and alterations of the mechanical properties in passive muscle tissue.

The application of a proper head and neck resistance training program will also result in increased resistance to deformation forces. As a stronger neck becomes less compliant to outside forces, reducing deformation of the neck, therefore displacement of the head will also be reduced.

The application of a proper head and neck resistance training program will also result in lowering of concussive and sub-concussive forces. Neck strength provides neck stabilization and bracing against impact. A stronger head and neck segment aids in skull placement rigidity, thus reducing concussion occurrence.

The application of a proper head and neck resistance training program will also result in enhanced ability to move the head quickly. A conditioned neck moves more fluidly with added strength. A stronger neck can exude movement that one would call increased athleticism.

The application of a proper head and neck resistance training program will also result in increased maximum oxygen uptake by strengthening the musculature that elevates the rib cage. The muscles used in heavy exertion breathing can be found between the ribs and between the neck and the upper ribs. The diaphragm, muscles between the ribs and one of the muscles in the neck, called the scalene muscle, are involved in almost every breath taken. If additional help is needed expanding the lungs, other muscles in the neck are recruited. The scalene muscles are lateral vertebral muscles that begin at the first and second ribs and pass up into the sides of the neck. There are three of these muscles. When the neck is fixed, the scalenus anterior muscle elevates the first rib to aid in breathing.

The application of a proper head and neck resistance training program will also result in increased blood flow to and from the brain to become more effective at cooling. The efficiency of selective brain cooling is increased by evaporation of sweat on the head and by ventilation through the nose. The increases in intravenous pressure gradient across the skull increase emissary flows and hence enhance the efficiency of brain cooling. Exercising the neck is known to increase blood flow to the brain. A properly conditioned neck can cool the brain more effectively.

The application of a proper head and neck resistance training program will also result in Reduction of headaches due to weakened head muscles. Several studies have shown that a well-trained, stronger head and neck reduces headaches. One reason is simply that a stronger neck does not fatigue during everyday activities while holding the head upright.

Finally, the application of a proper head and neck resistance training program will also result in increased balance and athleticism by training the hotbed of proprioception.

Proprioceptive inputs from the cervical musculature play an important role in head-eye coordination and postural processes. Muscle spindle density is extremely high in the deep muscles of the human neck.

Therefore, it is one object of embodiments of the present disclosure to provide progressive and varying resistance during exercise of the neck. Varying range and increased resistance is not possible using a conventional weight machine.

It is one object of embodiments of the present disclosure to provide a training apparatus and methods of using the apparatus to increase muscle strength in the head and neck region. Because the head is stabilized throughout the use of the apparatus, the neck and shoulders complete a full range of motion. Resistance provided by embodiments of the present invention allows a user to perform smaller movements, including rotational movements, of the head. Use of such an apparatus not only will improve neck strength, but it will also help athletes lower the risk of concussions. When a user is struck, the speed (i.e., the jolt) of the head is not as severe because of stronger, stabilizing neck muscles. As a result, the user reduces the severity of sub-concussive and concussive blows.

In one embodiment, an object is to provide an apparatus for monitored, controlled resistance training.

In another embodiment, an object is to provide an apparatus for neck muscle rehabilitation. The apparatus and methods are to be used by athletes, and supervised by athletic trainers, personal trainers, physical therapists, and others in the medical field.

In another embodiment, an object is to impose a training method that will cause the athlete's muscular system in the neck to adapt by increasing the size and strength of the specific muscle fibers in the neck used to accomplish the movement.

In another embodiment, an object is to provide a training method that will increase a user's neck strength so as to respond an action and respond to inhibit whiplash, sudden jolts or abnormal movement that could result in sub-concussions or concussions.

In another embodiment, an object is to provide an apparatus and methods for performing additional exercises, including, but not limited to, upright rows, bent-over rows, shrugs, and single arm press.

In previous apparatuses, full range of neck muscles could not have been utilized because of limitations of the apparatuses in the art. No other apparatus snuggly fits onto the user's head to allow for full range of motion and thus complete exercise of neck muscles. Therefore, it is another object of the invention to allow the apparatus allows tilt, rock, and rotate with non-slip resistance while the apparatus is around the head. The crucial feature of the invention is the wrap that snuggly surrounds the head. When the apparatus is in use, the component attached to the head strap is one of side of the head. The handle is pulled around to the opposite side of the head. The force of the pull causes enhanced tightening or snugness of the head strap.

When using the apparatus, the head and neck are secure. It allows for a short range of motion.

Further, the slideable adjustment mechanism accommodates varying amounts of resistance and varying arm lengths of users. It also allows for individual training.

In addition, the design of the present invention allows the apparatus to be light, portable, affordable, and easy to use. It is intended that users could be any gender and any age, including a child.

SUMMARY OF THE INVENTION

Apparatuses and methods for strengthening neck muscles are disclosed herein. In one embodiment, a device comprising a pair of tools for developing neck strength is described. This is used to build strength in the neck and in the supporting, stabilizing muscles of the upper back and shoulders. Users that increase neck strength decrease the likelihood of injury, improve their body control, and increase athletic performance. When the elastic tube is taut, the user will immediately have resistance against his head. With little slack in the resistance strap, the user will feel the resistance upon movement of the neck. This method of providing resistance at different points due to the slack in the elastic tube may be applied to other sports or to rehabilitation exercises. Increasing or stabilizing neck muscles against exterior linear and rotational forces throughout a full range of motion can decelerate the resultant speed of the head, reducing severity of sub-concussive and concussive blows.

In one embodiment, the disclosure teaches an apparatus for strengthening neck muscles comprising an adjustable head strap configured to wrap tightly around a head of a user; a hook and loop fastener component that attaches to the head strap; and elastic tube anchored at each end onto the hook and loop fastener component through grommets; and a handle attached at two positions of the elastic tube.

In another embodiment, the disclosure teaches a method of strengthening head, neck, shoulder, and back muscles, comprising the steps of selecting an apparatus that comprises an adjustable head strap configured to wrap tightly around a head of a user; a hook and loop fastener component that attaches to the head strap; an elastic tube anchored to opposite ends of the hook and loop fastener component through metal loops; and a handle with an elastic loop attached to the opposite end of the elastic tube. The user secures the head strap around a head of a user, attaches the hook and loop fastener component to the head strap, and extends the elastic tubes and the handle to the side of the head opposite to the hook and loop fastener component. The user then holds the handle so that the elastic tube is parallel to the ground, and rotates or extends the neck away from the handle. With repeated motions, the muscles of the neck are strengthened.

In another embodiment, the disclosure teaches an exercise stool that comprises a rotational and adjustable seat, wherein a seat of the stool is at least four feet off of the ground—high enough that the feet and legs are removed from supporting the leg movement; an adjustable bar that extends from the base of the stool; wherein the bar comprises a vertical bar that extends to the height of the user; and a hook at the top of the vertical bar that connects the handle of the apparatus. The hook connects to an apparatus that comprises an adjustable head strap configured to wrap tightly around a head of a user; a hook and loop fastener component that attaches to the head strap; an elastic tube anchored to opposite ends of the hook and loop fastener component through metal loops; and a handle with an elastic loop attached to the opposite end of the elastic tube.

DETAILED DESCRIPTION OF THE INVENTION

The present disclosure teaches apparatuses used to increase head, neck, and shoulder strength. The range of motion by the user is isotonic and isometric exercises, and therefore, allows the user to exercise more muscles in the head, neck and shoulder. In turn, a user with increased head, neck, and shoulder strength has more control of the head and neck during contact that jolts the head. With use of the present invention, the speed and acceleration of the head after contact will decreased, and the risk of concussion or sub-concussive blows is lowered.

Figure 1:
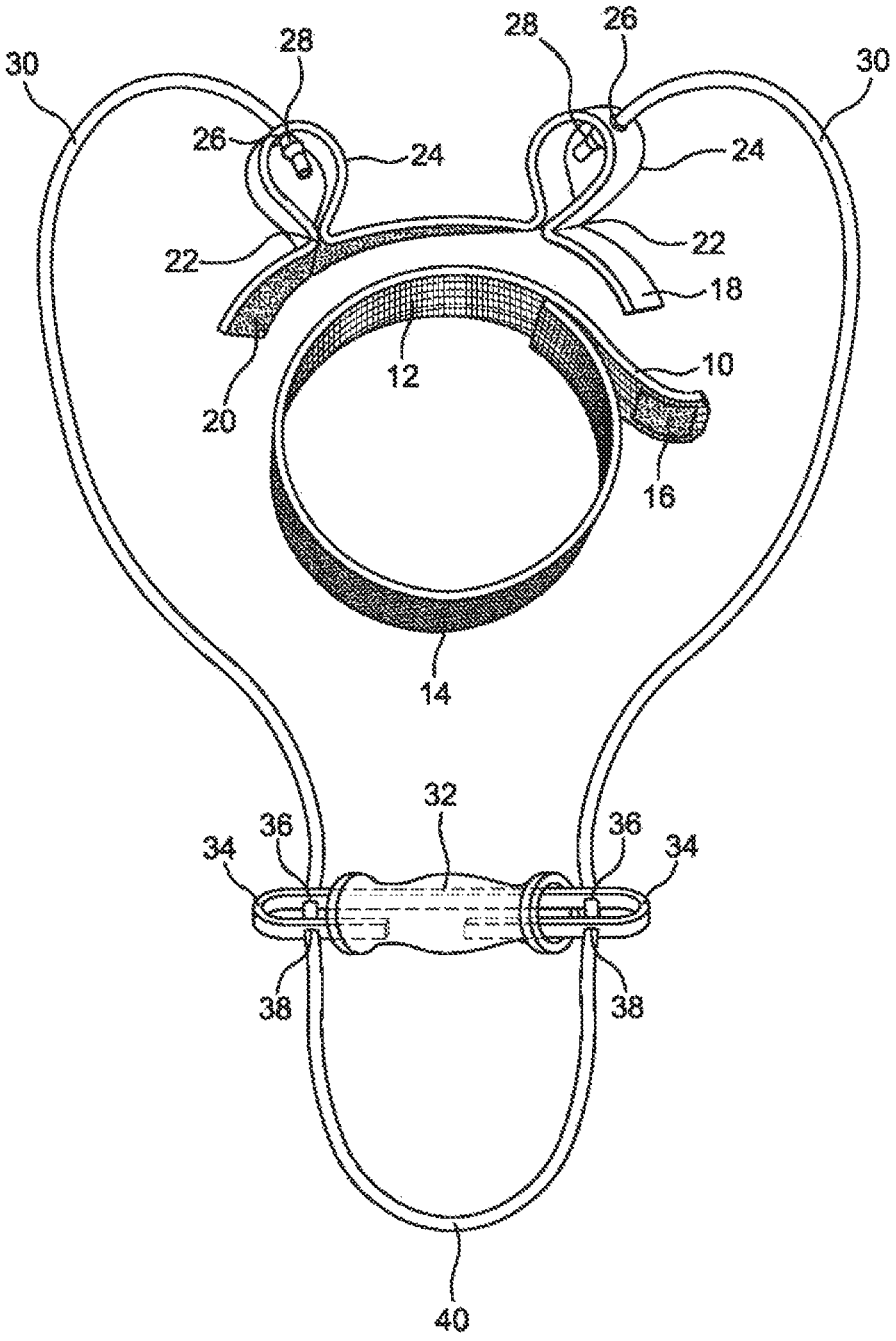
FIG. 1 provides the present invention. The invention comprises a head strap (10), a hook and loop fastener attachment (18), an elastic tube (30), and a handle (32).

In one embodiment, an apparatus comprises an elastic head wrap (10) that wraps around the head snugly at the forehead. See, FIG. 1. The head wrap comprises an inner layer (12); and outer layer (14); and a hook and loop fastener (for example, a VELCRO® pad) (16) that snugly secures the head wrap around the head of the user. The user attaches a hook and loop component (18) around a portion of the head wrap. The hook and loop component comprises a hook and loop fastener (20) that attaches to the head wrap; connections (22) (i.e., stitches, glue, adhesive, clips, etc.) that form two loops (24); openings (26) at the apex of the loop to connect the elastic tube (30) through the openings (26) wherein the elastic tube is knotted (28). The opening is a small hole (e.g., metal eyelet, grommet, etc.). Each hole is threaded with a release cord that extends to the first end of the resistance strap where the cords are threaded through two horizontally positioned holes (e.g., metal eyelet, grommet, etc.). The cords terminate into a releasing handle. The elastic tube (30) is about six feet long. At about the middle of the elastic tube is an adjustable handle (32), which has two holes that allow the user to adjust the position of the handle by sliding along the tube. Additional slack (40) of the elastic tube extends beyond the handle.

The head strap is made of durable material. Preferably, the inner layer (12) and the outer layer are made of nylon, polyprowebbing, elastic, hook and loop fasteners (for example, a VELCRO®).

The head wrap is adjustable. Because the hook and loop fastener pad (16) attaches to any part of the outer layer (14) of the elastic head wrap (10), the invention could be used by persons of any head size.

In one embodiment, the head wrap comprises indentations along the wrap that allow the wrap to fit comfortably around the ears of the user. In another embodiment, the invention comprises loops extend out from the head wrap and fit snugly and comfortably around the ears of the user.

The apparatus comprises a hook and loop component (18). The hook and loop component comprises neoprene, nylon, elastic rubber, and polyprowebbing. The apparatus comprises an elastic tube (30). The length of the elastic tube (30) is between four and eight feet. Preferably, the length of the entire elastic tube is six feet.

The apparatus comprises a handle (32). The handle comprises composition selected from, but not limited to, plastic, wood, neoprene, nylon, elastic rubber, and polyprowebbing. The length of the handle is between three and seven inches. Preferably, the length of the handle is five inches. The handle preferably is hollow and allows for an additional component (34) made of plastic, wood, neoprene, nylon, elastic rubber, and polyprowebbing to slide through the handle. This component (34) comprises two holes (36, 38) at each end of the handle, where the elastic tube (30) is securely but adjustably attached to the handle. The slideable adjustment mechanism accommodates varying amounts of resistance and varying arm lengths of users. The elastic tube is secure when the apparatus is in use.

The elastic tube (40) extends beyond the handle in a loop. In one embodiment, the elastic tube (40) could be two different pieces. In another embodiment, the elastic tube (40) weaves through handle. The extra slack in the elastic tube allows the user to adjust the position of the handle. Differences in the position of the handle allow the user to adjust resistance of the tube during exercise.

The hook and loop component (18) may be secured to the elastic tube (30) or to the head strap (10) by a variety of attaching means (e.g., VELCRO® or hook and loop fasteners, buckles, snaps, etc.). In addition, the handle (32) may be secured to the elastic tube by a variety of attaching means (e.g., VELCRO or hook and loop fasteners, buckles, snaps, etc.).

Figure 2:
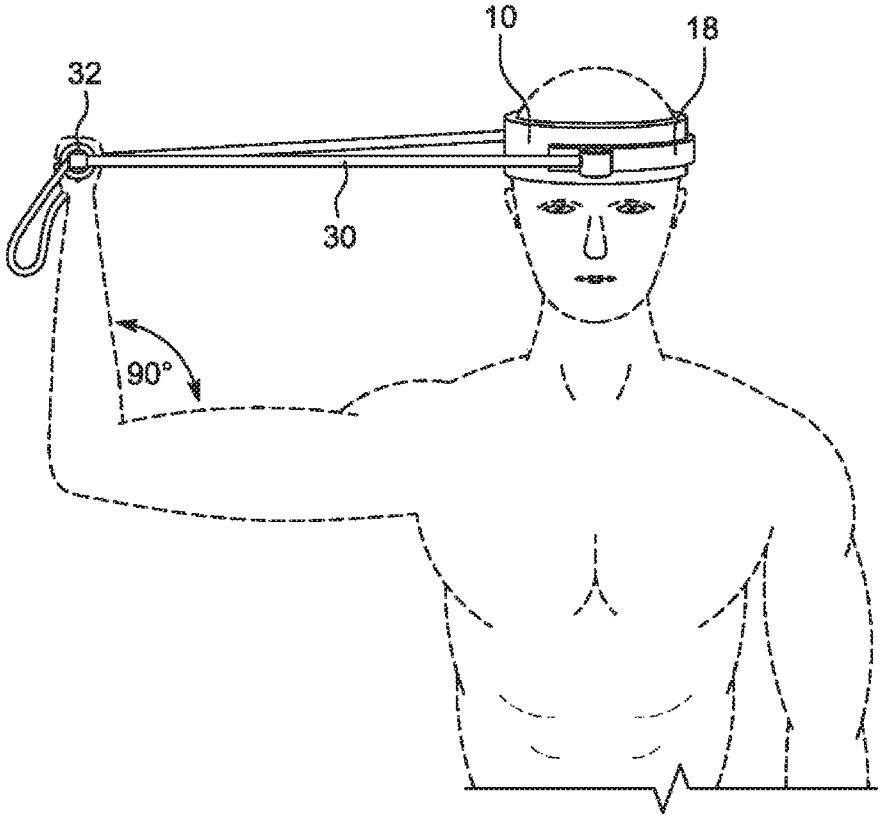
FIG. 2 provides a demonstrative of a user wearing and using the present invention.

The present disclosure also teaches methods for using exemplary apparatuses to increase head, neck and should muscle mass. In one embodiment, the user wraps the head strap (10) around the head. See, FIG. 2. An important feature of the present invention is that the head wrap is secured snugly and comfortably around the head, just above the ears. The user attaches the hook and loop component (18) to the head strap (10). In one embodiment, the user attaches the hook and loop component to the head strap on the side of the head. In another embodiment, the user attaches the hook and loop component to the head strap at the forehead. In another embodiment, the user attaches the hook and loop component to the back of the head. It is contemplated that the user could attach the hook and loop component at any position relative to the head.

The user then adjusts the elastic tube (30) and handle (32) to a preferred length. The handle and elastic tube extend to the opposite side of the head compared to the hook and loop component (18). Using the apparatus in this method allows the user to easily control the handle, and allows the user to exercise a full range of motion through both linear and rotational exercises.

The disclosure provides multi-planar movements that strengthen the complex musculature supporting the head and cervical spine through multi-planar movements. The body has three planes of motion: sagittal, front and transverse. The sagittal plane divides your body into right and left halves. In this plane, flexion and extension occur. The front plane divides your body into anterior and posterior halves, or front and back. In the frontal plane, abduction and adduction occur. The transverse plane divides your body into an upper and lower half. Internal and external rotation occurs in the transverse plane.

In one embodiment, the user extends the handle so that the elastic tube is horizontal to the ground. See, FIG. 2. Preferably, the user will set the handle so that there is a 90 degree angle between the biceps and the forearm. In additional embodiments, the user could adjust the position of the handle at any point along the elastic tube. When the elastic tube is taut, the user extends his neck away from the handle, and exercises his neck muscles. The user could hold the handle in all angles around the head (e.g., front, sides, and back).

Through the full range of motion that is allowed from the apparatus, the user's neck muscles will be strengthened.

Stronger neck muscles will provide the user with additional neck stability and control, which will help to reduce the risk of concussions that occur from rotational and straight-on collisions. Use of the apparatus also has the potential to limit concussions to sub-concussions and to limit sub-concussions to no concussions.

In one embodiment, the apparatus allows the user to perform flexion (chin to chest) ("YES" movement) exercises. In this exercise, the hook and loop component is attached to the front of the head. The user holds tubing behind your head, and grips the handle with both hands. In one embodiment, the user has a wall or post behind the body on which your hands can rest. The primary muscles exercised, strengthened, or developed are sternocleidomastoid, anterior scalene and middle scalene.

In one embodiment, the apparatus allows the user to perform Extension ("YES" movement) (tilt head back and chin upward) exercises. In this exercise, the hook and loop component is attached to back of the head. The primary muscles exercised, strengthened, or developed are the upper portion of the trapezius, semispinalis cervicis, longissimus cervicis, splenius cervicis and ligamentum nuchae.

In one embodiment, the apparatus allows the user to perform Lateral Flexion Left ("NO" movement) (move left ear downward toward left shoulder) exercises. In this exercise, the hook and loop component is attached to left of the head. The primary muscles exercised, strengthened, or developed are rectus capitis lateralis, obliquuus capitis inferior and superior, intertransversarii, multifidi, iliocostalis cervicis longus colli, levator scapulae, scalenus anterior and scalenus posterior.

In one embodiment, the apparatus allows the user to perform Rotation Left ("NO" movement) (keep chin level throughout movement; turn nose as far to the left as possible then slowly return to neutral position) exercises. In this exercise, the hook and loop component is attached to left of the head. The primary muscles exercised, strengthened, or developed are sternocleidomastoid, splenius capitus, levator scapulae, and upper trapezius.

In one embodiment, the apparatus allows the user to perform Lateral Flexion Right ("I DON'T KNOW" tilt/movement) (move right ear downward toward right shoulder) exercise. In this exercise, the hook and loop component is attached to right of the head. The primary muscles exercised, strengthened, or developed are rectus capitis lateralis, obliquus capitis inferior and superior, intertransversarii, multifidi, iliocostalis cervicis longus colli, levator scapulae, scalenus anterior and scalenus posterior.

In one embodiment, the apparatus allows the user to perform Rotation Right ("I DON'T KNOW" tilt) (keep the chin level throughout movement; turn nose as far to the right at possible then slowly return to neutral position) exercise. The hook and loop component is attached to right of the head. The primary muscles exercised, strengthened, or developed are the sternocleidomastoid, splenius capitus, levator scapulae, and upper trapezius.

It is to be understood that workout programs that utilize the present disclosure could be developed. In one embodiment, the user develops a two-day-a-week workout regimen. In another embodiment, the user develops a three-day-a-week workout regimen. In another embodiment, the user develops a four-day-a-week workout regimen. In another embodiment, the user develops a five-day-a-week workout regimen. In another embodiment, the user develops a six-day-a-week workout regimen. In another embodiment, the user develops a seven-day-a-week workout regimen.

Figure 3:
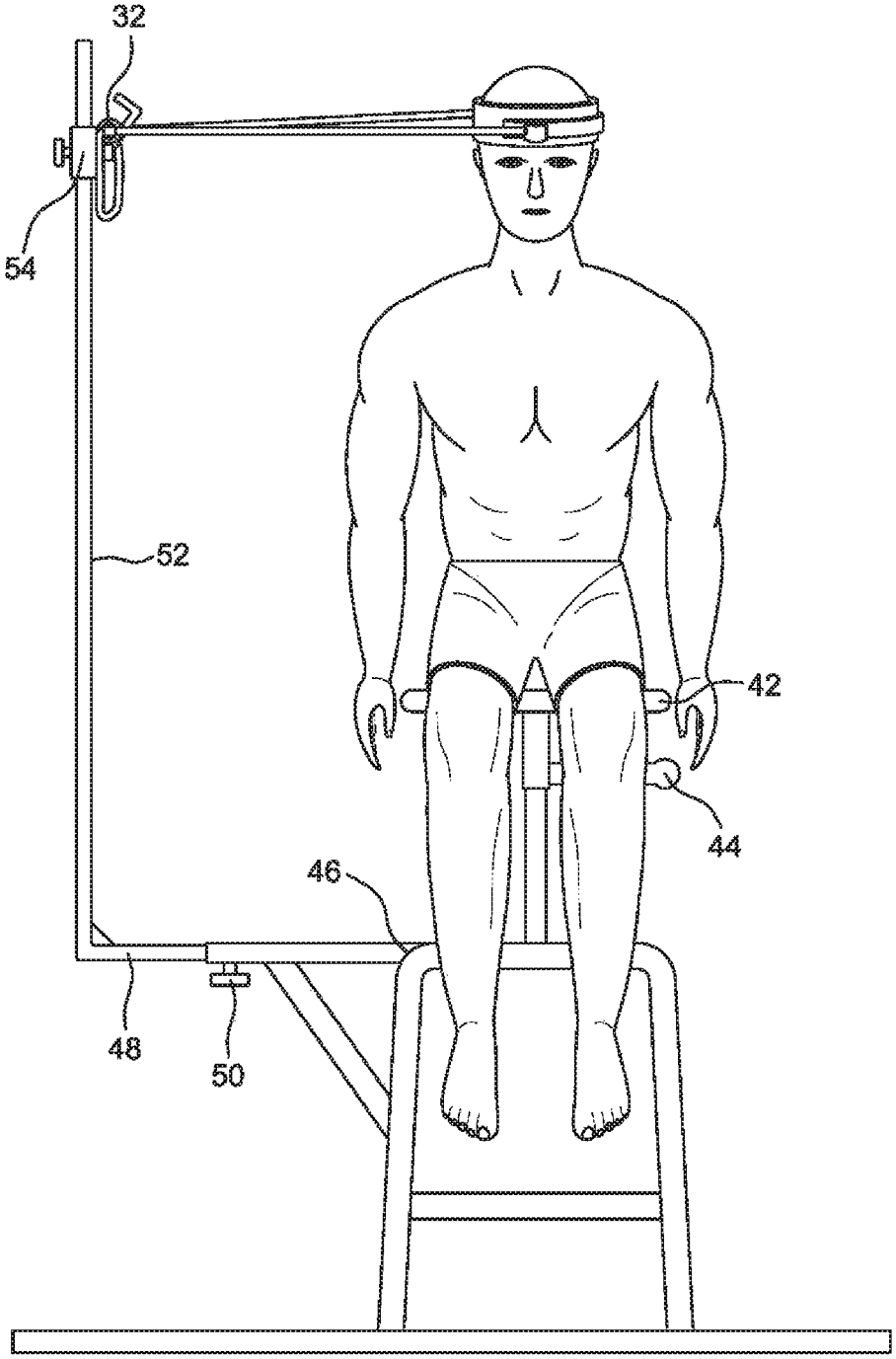
FIG. 3 provides a user sitting on the stool of the present invention utilizing the head and neck exercise equipment.

The present disclosure also teaches a rotating stool. In one embodiment, a rotating stool (42) locks in position through a lever (44) on the side of the stool. When locked, the stool does not rotate and is set to a preferred height. The user sits on the stool so that the legs do not touch the ground. See, FIG. 3. At the base (46) of the stool is a bar (48) that extends horizontally from the base. The extension is adjustable through the use of a pin and lock system (50). In one embodiment, the horizontal bar extends two feet from the base of the chair. In one embodiment, the horizontal bar extends three feet from the base of the chair. In one embodiment, the horizontal bar extends four feet from the base of the chair.

The horizontal bar (48) is attached to a vertical bar (52). The vertical bar (50) comprises a hook (54) to connect it securely with the handle (32) of the present invention. Once secured, the user could perform head and neck exercises as previously described.

Preferably, the stool rotates 360 degrees. Depending on where the user locks the stool, the user is able to exercise muscles in the front, sides and back of the head and neck. The full range of motion allows the user to strengthen the entire range of head and neck muscles. In addition, because the chair locks, the user is also able to perform rotational exercises (e.g., nodding "yes," shaking the head "no,"0 and rotating the head from shoulder to shoulder).

Methods involving the stool system further allow the user to stabilize shoulders and chest. In doing so, the rotation of the head and neck is more dramatic. The muscles of the neck are further strengthened.

In one embodiment, the disclosure teaches a system comprising a stool and an apparatus for strengthening neck muscles comprising an adjustable head wrap configured to wrap tightly around a head of a user; a hook and loop fastener component that attaches to the head strap; an elastic tube anchored to opposite ends of the hook and loop fastener component through metal loops; and a handle with an elastic loop attached to the opposite end of the elastic tube. Use of the system improves neck strength and lowers the risk of concussions.

Figure 4:
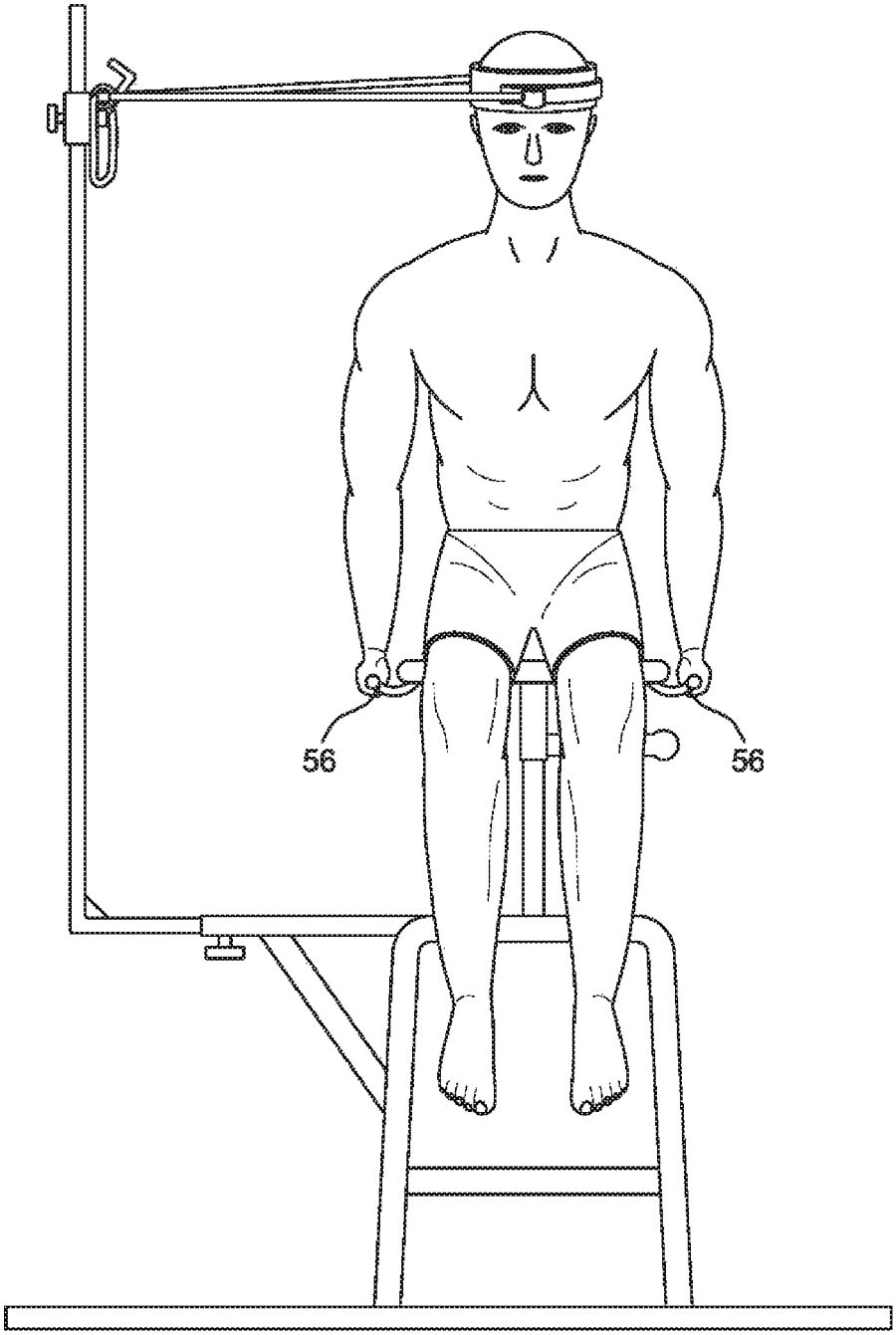
FIG. 4 provides a user sitting on the stool of the present invention utilizing the head and neck exercise equipment while using handles of the stool.

It is important that the feet of the user do not touch the ground. When the user's feet are not securely on the floor, the head and neck exercises further target and strengthen muscles of the head and neck. In one embodiment, the stool comprises handles (56) that the user holds for balance. See, FIG. 4. The intent of this embodiment is to allow the user to conduct exercises without his feet on the floor. In one embodiment, the seat of the stool is about three feet from the ground. In another embodiment, the seat of the stool is about four feet from the ground. In another embodiment, the seat of the stool is about five feet from the ground. In another embodiment the seat of the stool is about six feet from the ground.

It is to be understood that the above described embodiments are merely illustrative of numerous and varied other embodiments which may constitute applications of the principles of the invention. Such other embodiments may be readily devised by those skilled in the art without departing from the spirit or scope of this invention and it is understood that they be deemed within the scope the claimed invention.

The invention claimed is:

1. An apparatus for strengthening neck muscles comprising:

a. an adjustable head strap configured to wrap tightly around a head of a user, comprising:

i. an outer layer capable of attaching to a first hook and loop fastener component; and ii. an inner layer, made of a material capable of providing non-slip resistance while the apparatus is around the head of the user, that comprises a second hook and loop fastener component at one of two ends of the adjustable head strap, wherein the second hook and loop fastener component is capable of attaching to the outer layer;

b. the first hook and loop fastener component that attaches to the adjustable head strap;

c. an elastic tube anchored at each end to the first hook and loop fastener component through metal loops; and d. a handle attached at two positions of the elastic tube;

wherein the elastic tube and the handle are capable of being extended to a side of the head of the user opposite to the first hook and loop fastener component.

2. The apparatus of claim 1, in which the elastic tube loops through the handle, and wherein holes in the handle allow the user to adjust a length of the elastic tube.

3. The apparatus of claim 1, in which the elastic tube is about four to eight feet in length.

4. The apparatus of claim 3, in which the elastic tube is about six feet in length.

5. The apparatus of claim 1, wherein the metal loops comprise an eyelet or a grommet.

6. A method of strengthening head, neck, shoulder, and back muscles, comprising the steps of:

a. selecting an apparatus comprising:

i. an adjustable head strap configured to wrap tightly around a head of a user comprising:

1. an outer layer capable of attaching to a first hook and loop fastener component; and 2. an inner layer, made of a material capable of providing non-slip resistance while the apparatus is around a head of a user, that comprises a second hook and loop fastener component at one of two ends of the adjustable head strap, wherein the second hook and loop fastener component is capable of attaching to the outer layer;

ii. the first hook and loop fastener component that attaches to the adjustable head strap;

iii. an elastic tube anchored to opposite ends of the first hook and loop fastener component through metal loops; and iv. a handle attached at two positions of the elastic tube;

b. securing the adjustable head strap around the head of the user;

c. attaching the first hook and loop fastener component to the adjustable head strap;

d. extending the elastic tube and the handle to a side of the head opposite to the first hook and loop fastener component;

e. holding the handle so that the elastic tube is parallel to a ground surface;

f. extending or rotating the neck away from the handle; and g. repeating the extending or rotating neck motion;

thereby strengthening the muscles of the head, neck, shoulder, and back.

7. The method of claim 6, wherein strengthening the muscles of the neck limits the risk of concussion or sub-concussions.

8. The method of claim 6, wherein the user attaches the first hook and loop fastener to any side of the adjustable head strap.

* * * * *